US005354992A

United States Patent [19]

Thompson et al.

[11] Patent Number: 5,354,992

[45] Date of Patent: Oct. 11, 1994

[54] TILT COMPENSATED ERROR CORRECTING SYSTEM

[75] Inventors: Gary J. Thompson, Akron; Thomas Tillander, Bay Village; David E. Harris, Powell, all of Ohio

[73] Assignee: The North American Manufacturing Company, Cleveland, Ohio

[21] Appl. No.: 18,280

[22] Filed: Feb. 16, 1993

[51] Int. Cl.[5] ..... G01N 21/86

[52] U.S. Cl. ..... 250/548; 356/400

[58] Field of Search ..... 250/548, 561, 559, 571, 250/557; 356/401, 400; 358/494; 226/19, 3, 28, 17

[56] References Cited

U.S. PATENT DOCUMENTS

| | | | |
|---|---|---|---|
| 2,566,399 | 9/1951 | Bishop | 250/548 |
| 4,291,825 | 9/1981 | Glanz | 226/18 |
| 5,058,793 | 10/1991 | Neville et al. | 226/15 |
| 5,191,280 | 3/1993 | Van derWerf et al. | 250/548 |

*Primary Examiner*—David C. Nelms
*Attorney, Agent, or Firm*—Vickers, Daniels & Young

[57] ABSTRACT

A system for creating a position correcting error signal indicative of the lateral displacement of the center of a strip from a control position for the center of a nearly flat strip having a width and first and second generally parallel edges, as the generally flat strip moves along a given feed line past a given location, where the error signal creating device including means for detecting the orthogonally projectable, one dimensional lateral position of the first edge of said moving strip at said given location, means for detecting the orthogonally projectable, one dimensional lateral position of the second edge of said moving strip at said given location. The system includes transducer means for detecting the lateral tilt angle of the strip at said given location, means for creating an electrical value based upon said detected tilt angle, means for creating edge signals indicative of the detected lateral positions of the edges of the web, and means responsive to the edge signals and the electric value for providing a tilt responsive error signal for reducing said lateral displacement of the web center from said central position for the web center.

31 Claims, 6 Drawing Sheets

FIG. 1
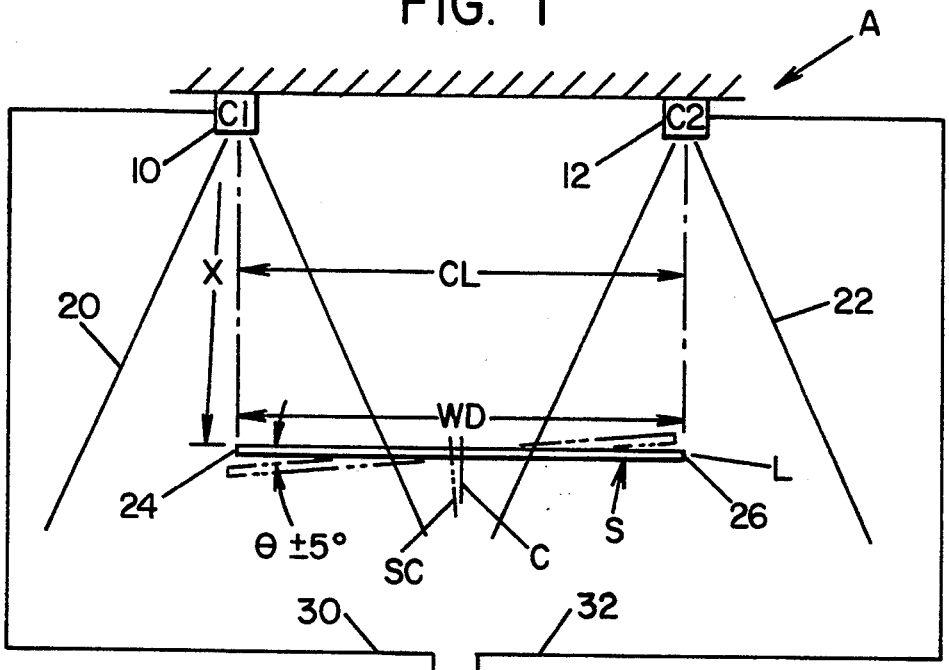
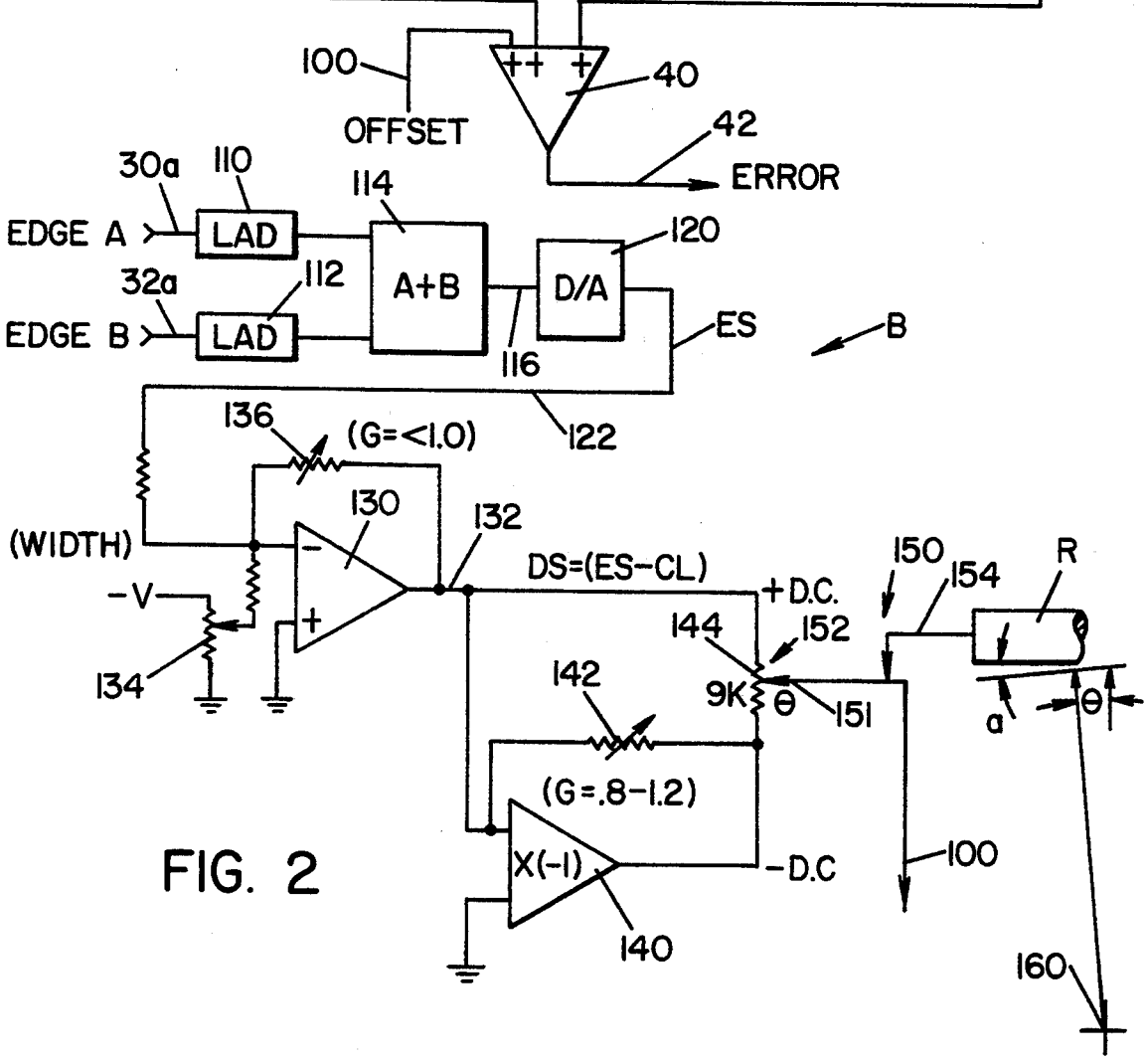
FIG. 2

FIG. 6
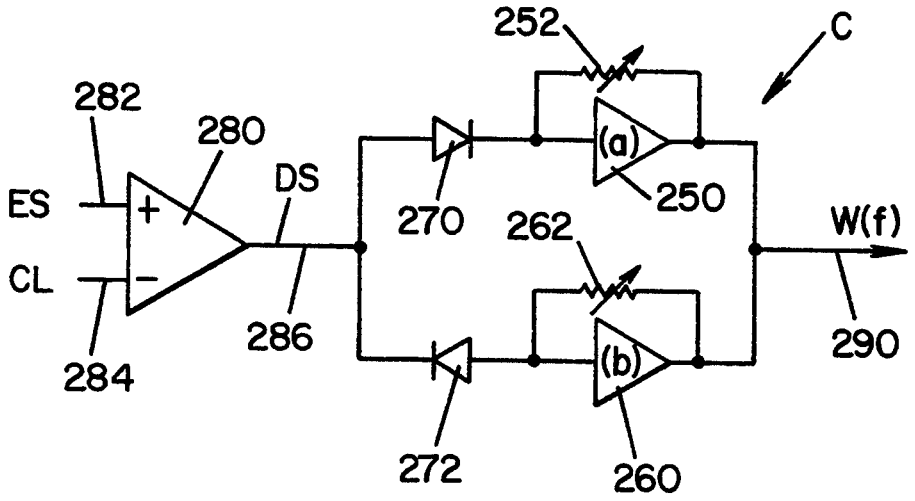
FIG. 7
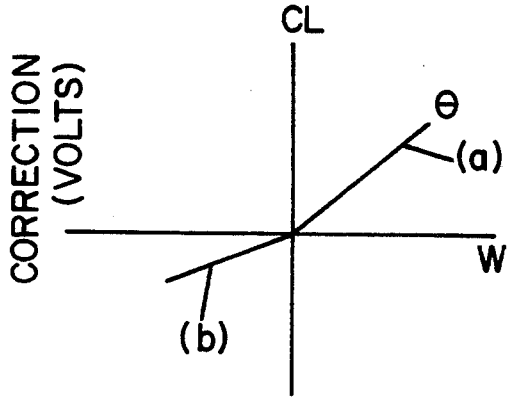
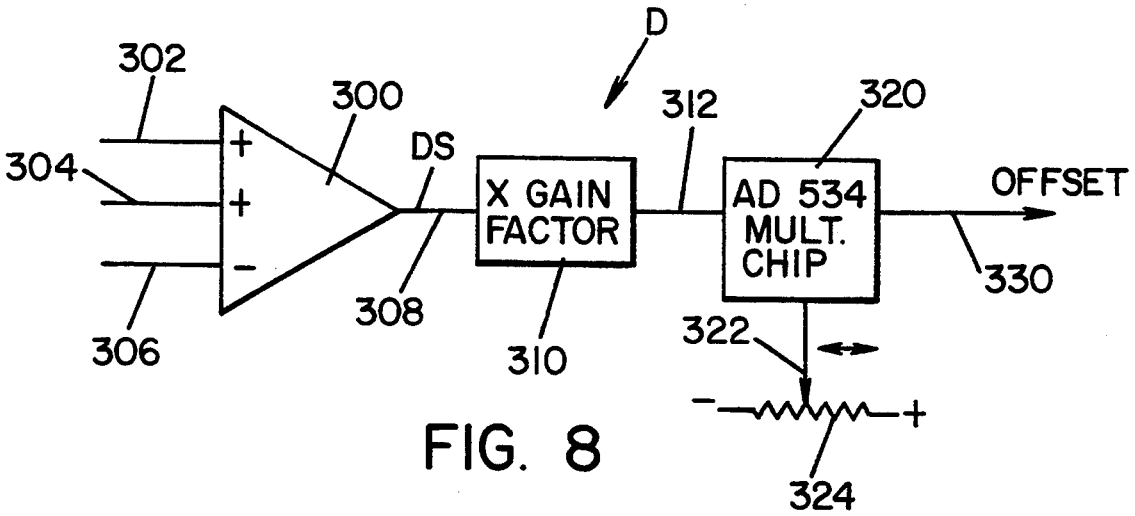
FIG. 8

FIG. 11
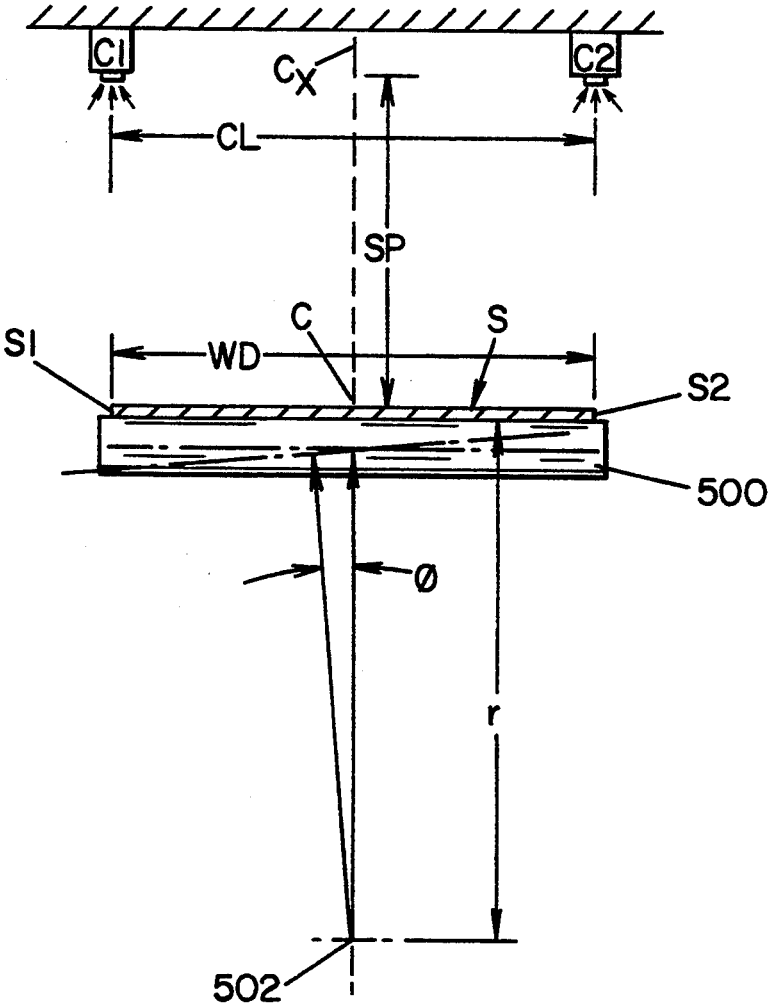
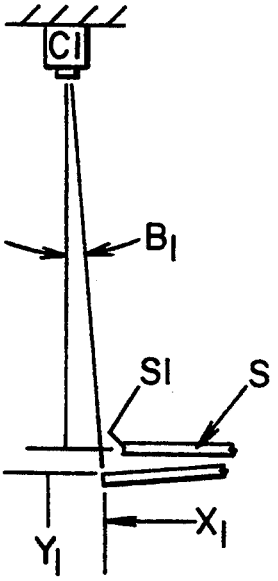
FIG. 12
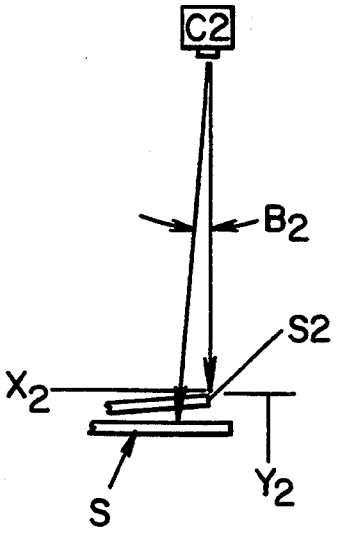
FIG. 13

TILT COMPENSATED ERROR CORRECTING SYSTEM

DISCLOSURE

The present invention relates to the art of controlling the centered position of a moving web and more particularly an improvement in a device that detects the deviation of a moving strip in a lateral direction from a desired controlled centered position by employing one or more non-contact detectors. These detectors sense the position of the parallel edges of the web by cameras, lasers, LED arrays and related non-contact line of sight detectors. The improvement is a system for compensating for the tilt of the web as it moves past the location at which the detection occurs. For the purpose of the application web and strip are used interchangeably to mean any flat moving material being guided.

BACKGROUND OF INVENTION

The present invention is particularly applicable for use with linear detectors that use a conical field of view, such as two spaced cameras, at the exit position of a displacement guide roll in a web guiding system, wherein a guide roll is tilted about a lower spaced pivot point to adjust the angular disposition of the moving web to guide the web in a centered position through the system, and the invention will be described with particular reference thereto; however, the invention has much broader applications and may be used for various linear detector systems such as laser detectors, LED array detectors, and other non-contact detectors wherein the edges of the web or strip are detected and their relative sensed positions are employed to determine the lateral displacement of the web from the desired centered position. In these types of web guiding systems, a camera views each edge of the moving strip and uses the sensed strip edge positions in an attempt to determine the lateral position of the moving web. This is accomplished by combining the detected or sensed positions of each edge. To adjust the web from its actual position to a desired centered position, an error signal is created. The magnitude and polarity of the error signal is employed for the purpose of adjusting the actual position of the strip by shifting the strip in a direction necessary to reduce the error signal and, thus, the difference between the actual web position and the desired web centered position. The magnitude of the error generally controls the velocity or rate of position correction. Several systems using cameras, lasers, ultrasonic transmitters, LED arrays and similar edge detecting devices are known in the art. As background information, U.S. Pat. No. 5,058,793 is incorporated by reference herein. This patent shows how a position correcting error signal is employed for the purpose of correcting the centered position of a moving web. This system is only representative in nature and is referenced so that details of the actual position correcting system itself need not be repeated herein. The present invention relates to an improvement involving a tilt compensating system or circuit for use in a position correcting device that employs a device for creating an error signal that not only considers the lateral spacing of the web edges, but also the amount of tilt of the strip. This error signal with tilt compensation is used for strip or web correcting in a web conveying and guiding system.

Spaced cameras viewing the opposite edges of a moving web have a conical field of view which intercepts the spaced edges of the web. The camera detectors "see" only a one dimensional lateral view or shadow of the respective parallel edges of the web. The camera can not determine the perpendicular spacing of the web from the camera or the difference between perpendicular positions of the web edges. This difference is created when the web is tilted from the normal plane of the detecting system. Thus, the detected or sensed edges obtained by the conical field of view of the spaced cameras in a detecting system is only the orthogonally projectable or viewable one dimensional lateral position of the respective parallel edges. There is no economical scheme for the spaced cameras to detect tilt; therefore, when the web is tilted it appears that the web is off center more or less than is the situation, since, for example, an edge tilted closer to the camera can block more of the field of view than the edge which is tilted further from the camera. Consequently, if the web is indeed perfectly centered in the desired controlled position for the moving web, tilting of the web will cause the error detector to create an error signal inaccurately indicating to the position controlling system that the web is off center. Thus, centerline correction is somewhat complicated. The tilting of the moving web distorts the camera view for detecting the actual position of the moving web. This is an inherent deficiency in most non-contact width detector systems that create an error signal indicative of a lateral offset position of the moving web. The discrepancy caused by tilt is less when the web is actually centered and is more pronounced as the web is actually off center. The inaccuracy caused by tilt is more pronounced as the strip is closer to the cameras. For that reason, detector systems have normally been spaced a greater distance from the actual web to minimize the discrepancy caused by tilt of the web. When the non-contact detectors are 20–40 inches from the moving web, the tilt error is significant. By increasing the spacing to a value in excess of 50 inches, the tilt error is less troublesome. Consequently, there is a tendency to space the web substantially from the detectors. This greater spacing causes other problems, such as lack of physical space available for the system and atmospheric contamination in the area between the web and the cameras. For these reasons, there has been substantial difficulties encountered in use of cameras with conical field of view for use in the exit span of the web detector system. This same problem of tilt error is present in other detector systems of the type using a conical field of view or even in an LED array, such as the ACCUWIDE series of non contact measurement sensors sold by North American Manufacturing Company of Cleveland, Ohio. All of these detector systems for creating a web displacement error signal have the difficulty that they are somewhat inaccurate due to the inability to discriminate between offset of the web and tilt of the web.

THE INVENTION

The present invention overcomes the disadvantages especially attributed to two spaced cameras each having a conical field of view for detecting the spaced parallel edges of a moving web to create an error signal, which error signal is ultimately employed for the purpose of correcting the lateral position of the moving web. In accordance with the invention, there is provided a system for a detector device that creates a position correcting error signal indicative of the lateral displacement from a control position of a nearly flat web having a width and first and second generally parallel edges. This position correcting error signal is created by a system including a first detector means for detecting the orthogonally projectable, one dimensional lateral position of the first edge of the moving web at a given location and a second detector means for detecting the orthogonally projectable, one dimensional lateral position of the second edge of the moving web at the same given location. These two detectors are spaced from each other a given distance, referred to generally as the centerline distance. In addition, these non-contact detectors are spaced from the web in a perpendicular direction a distance referred to as the "spacing amount". In the past, this spacing amount was increased substantially to overcome the error introduced by web tilting as the web moved through the detector system. The error signal creating device to which the invention is particularly directed includes an arrangement for comparing the lateral or out board positions of the first and second edges of the web to generate the desired error signal. The magnitude of the error signal determines the rate of position correction as defined in U.S. Pat. No. 5,058,793, incorporated by reference herein. The electrical polarity of the error signal is indicative of the direction in which the correction of the web position is to be effected. The error signal attempts to correct the lateral position of the moving web for centering the moving web. In this type of system, there is provided transducer means for detecting the tilt angle of the moving web, means responsive to said tilt angle and said detected edge positions for creating a center offset signal indicative of the actual center of the web, means responsive to the center offset signal to correct the actual center of the web.

An analog implementation of the invention includes a tilt compensating circuit or system including transducer means for detecting the lateral tilt angle of the web at the detected location, means for creating an electrical value based upon the detected angles, means for creating a difference signal indicative of the difference between the centerline spacing of the detector means and the approximate width of the web itself, means for multiplying this difference signal and the created electrical signal derived from the tilt angle to produce an offset signal. This offset signal is then arithmetically combined with the normal error signal created by the detecting device so that there is provided a tilt compensated error signal for reducing the lateral displacement of the web from the controlled centered position.

In accordance with another aspect of the present invention, the detectors are cameras with conical fields of vision and spaced from each other a centerline distance. If the width of the strip equals the centerline distance, the tilt compensation is zero. There is no tilt error in this situation. The basic error signal is indicative of the transverse position of the web itself.

In practice, a single camera can be employed for viewing both edges of the moving strip. In this instance, the centerline distance is zero so the signal indicative of the width of the strip is multiplied by a value indicative of the detected angle of the web to create the offset signal which signal is combined with the normal error signal to produce the tilt compensated error signal.

The edge detected positions from the normal error detector system is compared with the centerline spacing of the cameras to produce a difference signal DS which is the difference between those two measurements, i.e. the centerline spacing of the cameras and the lateral edge spacing of the web. The magnitude of the centerline signal is adjusted manually for a given camera mounting geometry. The difference signal DS is then modified by a gain factor, which is dependent upon various physical parameters and set up of the detector system. The gain factor can be adjusted manually for a particular installation. The difference signal is adjusted in magnitude by the adjusted gain to compensate for the physical characteristics of the system. This produces an output signal which is then multiplied by the detected angle of the strip so the correction or effect is a linear function of the strip width with a slope indicative of the strip tilt angle. Consequently, the difference signal is multiplied by the angle setting to give the offset signal. The multiplication is a slope. In one analog embodiment of the invention, the slope of the correction multiplication is accomplished by an adjustable potentiometer. In accordance with an aspect of the invention, each angle of the web has its own linear slope which is employed for the purpose of determining the correction offset signal controlled by the difference signal which is the arithmetic subtraction of the set centerline signal and the detected lateral edge spacing derived from the normal error generating detector system.

In some systems, the difference signal DS may be a signal generated by the detector system and in other systems two separate signals are received from the spaced cameras to give a lateral spacing which is compared to the centerline spacing CL of the cameras. These two signals from opposite edges of the web are combined to produce the actual spacing signal , which spacing signal is then compared to the camera centerline distance manually adjusted in the system to give difference signal DS. The position detected by the two cameras is normally employed for creating the error signal. The offset signal obtained by use of the present invention is scaled and is used as a feedback signal to modify the normal error signal so that the ultimate corrective signal is a tilt compensated error signal. If the centerline spacing between the cameras and the width of the web are the same, there is no offset correction, since this condition creates no apparent deviation caused by tilt. The analog embodiments of the present invention have proven applicable for tilt angles less than about 5°–10°, which value is well within the normal operating condition of moving strips passing through the exit span of displacement guides using spaced cameras. In the digital implementation the angle of tilt is not limiting.

To practice the preferred embodiment of the invention, the apparent width of the material is determined. This spacing measurement is compared to the centerline spacing of the cameras. By comparing a ratiometric signal of strip edge spacing and camera centerline spacing, the difference of these two signals is then multiplied by the angle of the tilt to produce the tilt offset signal. The angle is obtained from a feedback transducer controlled by the strip guide roll itself, or by other arrangements for detecting and creating a signal indicative of the actual angle of the pivoted support structure supporting the steering roll of the web as the web passes under the conical field of view of the respective cameras detecting the edges of the strip. Since the tilt of the support roll does not appear to be an off center condition when the strip spacing is equal to the centerline spacing of the cameras, the system creates a null signal when this condition exists. Consequently, the first determination of the tilt compensating system is to determine whether the centerline spacing of the cameras or other detectors is equal to the spacing between the edges of the strip. If the edge spacing is not equal to the centerline spacing, then the difference of the distances in electrical signal format is compared to an electrical value, which value is controlled by the angle of the guide roll over which the strip or web passes. It has been found that the tilt angle, which is from the lower pivot support of the roll, and its relationship to the difference between the edge spacing and camera centerline spacing is approximately a straight line function to obtain the correction offset signal. This is especially true in the first quadrant, as shown in FIG. 4. In the third quadrant, i.e. when the difference between the edge spacing and centerline spacing is negative, a different linear function or slope may be employed for each tilt angle. This can be done by manually setting separate gain adjusted amplifiers which are selectively employed according to the polarity of the difference signal between the strip width and centerline spacing of the cameras. In this manner, an even more accurate offset signal is obtained when the apparent width of the strip, i.e. the spacing of the edges, is smaller than the centerline spacing, as well as when the spacing difference is substantially greater than the centerline spacing. In each of the first and third quadrants, the gain is a straight line function, i.e. is linear in nature, and is determined by the tilt angle of the web which is sensed by a transducer reading the tilt position of the guide roll.

When a single camera is employed, the centerline spacing between the fields of view is zero. There is only one conical field. Consequently, the difference signal DS for the tilt compensating system of the present invention is equal to the apparent spacing of the strip edges. In this instance, the offset correction signal is the edge spacing signal times electrical value controlled by the tilt angle of the web.

An enhancement of the system is employed when the gain factor of the present invention has one value when the width is greater than the camera centerline spacing, i.e. positive, and another value when the width is less than the centerline spacing, i.e. negative. This dual control system allows more accurate control of the offset signal irrespective of the relative width of the web being detected.

The gain factor as previously described for changing the magnitude of the difference signal DS, is also adjusted according to the perpendicular spacing of the web from the cameras. Thus, the spacing of the cameras from the strip is a factor affecting the magnitude of the tilt induced error in the control system of the invention.

In the broadest aspect of the invention, the two spaced edge positions and the tilt angle create a signal indicative of how far the center of the strip is actually spaced from the center of the control system. This error signal is used in a standard position control to adjust the guide roll. The tilt angle can be detected by either the actual movement of the strip or the support structure for the guide roll at a known location or by a calculation using the radius of the pivot arm of the guide roll.

One of the primary objects of the present invention is the provision of a tilt compensating system and method for a standard error signal creating device for controlling the lateral position of a moving strip, which system and method compensates for tilt errors, even when the web is held close to the cameras, such as substantially less than about 40 inches.

Another object of the present invention is the provision of a tilt compensation system and method for a device that creates a position correcting error signal indicative of the lateral displacement of a web from a control position, which compensation system and method can be easily employed to modify the standard error signal by a slight amount indicative of the tilt angle of the strip.

Yet another object of the present invention is the provision of a system and method for creating an offset signal indicative of the tilt of a moving web that passes through a detector system of the type having a circuit to create a position controlling error signal, which system and method is positive in operation, is useful for tilt angles in the normal range of less than about 5° and provides a slight trimming of the standard error signal to more accurately control the position of a moving web.

These and other objects and advantages will become apparent from the following description taken together with the accompanying drawings.

BRIEF DESCRIPTION OF DRAWINGS

FIG. 1 is a schematic layout of a standard displacement guide detector system for creating an error signal of the type used in strip or web guiding systems;

FIG. 2 is a schematic wiring diagram of the first preferred embodiment of the present invention using analog concepts;

FIG. 6 is a wiring diagram illustrating further modification of the preferred embodiment of the present invention;

FIG. 7 is a graph similar to FIG. 4 showing operation of the modification shown in FIG. 6;

FIG. 8 is a wiring diagram illustrating a further implementation of the present invention;

FIG. 11 is a geometric layout drawing showing parameters used in a second embodiment of the invention;

FIGS. 12 and 13 show the edge detecting feature of the present invention usable in any embodiment; and, FIG. 14 is a block diagram of the digital embodiment of the present invention.

PREFERRED EMBODIMENTS

Figure 3:
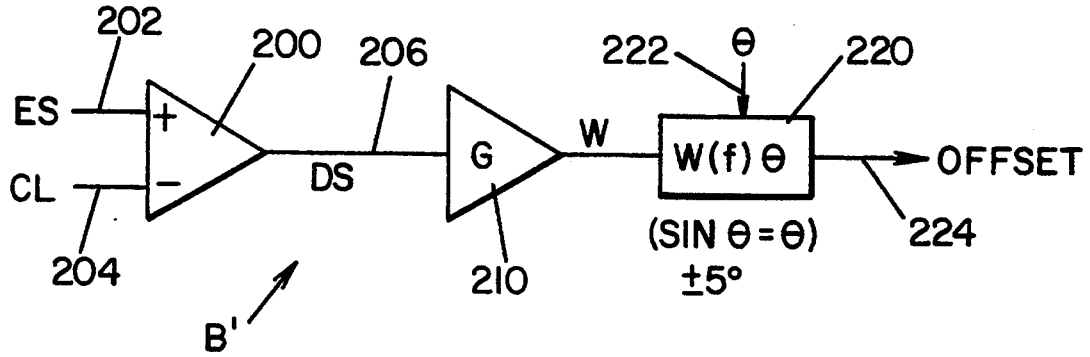
FIG. 3 is a simplified block diagram of the preferred embodiment of the present invention as shown in FIG. 2.

Referring now to the drawings wherein the showings of FIGS. 1–10 are for the purpose of illustrating preferred embodiments of the present invention using analog concepts, FIG. 1 shows a somewhat standard detector system A including two laterally spaced cameras 10, 12, each of which has a conical field of view 20, 22. The cameras are spaced from each other a centerline distance CL defined by the center of the field of view 20 and field of view 22. In accordance with standard practice, web or strip S passes under cameras 10, 12 along a feed line L which is in the field view of the cameras and is shown as being parallel to cameras 10, 12. Web S has a width WD which is viewed in an orthogonally projectable, one dimensional manner by cameras 10, 12, respectively. Camera 10 sees the lateral position of generally parallel edge 24. In a like manner, camera 12 sees the lateral edge 26. The cameras do not distinguish perpendicular spacing of these edges. In accordance with standard practice, cameras 10, 12 produce position indicating signals in lines 30, 32 that are directed to an error amplifier 40 having an output line 42. By comparing the relative positions of edges 24, 26, or apparent spacing of these edges, as determined by the voltage levels in lines 30, 32, respectively an error signal is created in line 42, which error signal is employed for the purpose of shifting the lateral position of web S as it passes along feed line L. This type of system is employed for the purpose of maintaining strip or web S centered under cameras 10, 12, as the strip is moved longitudinally along the feed line. If the strip slightly tilted in a longitudinal direction the center of the system C is not the center of the SC. The error signal in line 42 will indicate a lateral displacement of the strip which is incorrect. Thus, there is a slight error in the error signal caused by tilting the strip as it moves past the location where cameras 10, 12 detect edges 24, 26. If the strip itself were only laterally displaced, the error signal would correct the lateral position. However, in the system the web is tilted which causes deficiencies in the final adjustment of the centered position of the moving strip or web S unless steps are taken to compensate for the tilt induced error. Thus, it is an object of the present invention to compensate the voltage signal in line 42 in accordance with the tilt angle of web S to provide final adjustment of the strip into the desired center location, irrespective of the tilting of the strip as it passes under the cameras 10, 12.

The tilt compensation offset signal of the preferred embodiment is received by the standard error amplifier 40 through line 100, as shown in FIGS. 1 and 2. This offset signal in line 100 is created by the circuit B which is the preferred embodiment of the invention using analog concepts and is illustrated in FIG. 2. Signals in line 30a, 32a are indicative of the detected position of the edge and generally correspond to the signals in lines 30, 32 of FIG. 1. These signals are loaded by digital registers 110, 112 into a summing routine represented by box 114 to obtain a digitized edge spacing signal in line 116. This digitized signal is transferred, either serially or in parallel, to the input side of converter 120 having an analog output 122. The digital to analog converter 120 produces a voltage signal ES in line 122 indicative of the detected edge spacing of strip S. Comparator 130 in the form of a differential amplifier produces a difference signal DS, or (ES−CL), in line 132. This difference signal is the difference between the spacing signal ES in line 122 and the adjusted voltage at potentiometer 134, which is adjusted to correspond with the centerline spacing CL between the centerlines of cameras 10, 12. Consequently, if the spacing ES equals spacing CL, a zero voltage appears in line 132 and no offset is created in line 100. The gain G of amplifier 130 is adjusted by resistor 136 to calibrate the system. In practice it has been in the general range of less than 1.0. This gain adjustment is made to calibrate the tilt compensating system or circuit B as shown in FIG. 2. This compensation is for the spacing amount X between feed line L and cameras 10, 12. The gain is also trimmed to adjusted for the mechanical parameters of the guiding system such as the size of the guide roll and geometrical relationships. In practice this gain has been adjusted to about 0.3–0.8 to compensate for the camera spacing and other variables. Inverting amplifier 140 has a gain adjusted by resistor 142 to apply a voltage across resistor element 144. This resistor voltage is the difference between the positive voltage in line 132 and the negative voltage in the output of the inverting amplifier 140. This amplifier is to set the effective zero position of potentiometer 152. An angle feedback transducer 150 senses the angular disposition of guide roll R as it pivots about point 160, which is the lower pivot center of the frame carrying roll R. The voltage pick off point on resistor 144 is adjusted by moving the wiper 151 of potentiometer 152 through a mechanical element 154. Movement of the element 154 by pivoting roll R adjusts the position at which the offset signal in line 100 is obtained from resistor 144.

Figure 4:
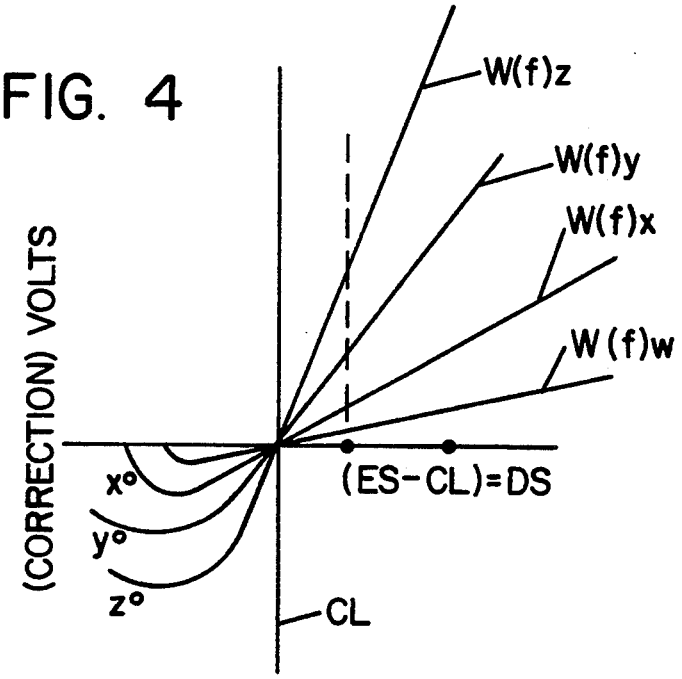
FIG. 4 is a graph illustrating mathematical features of the present invention.
Figure 4A:
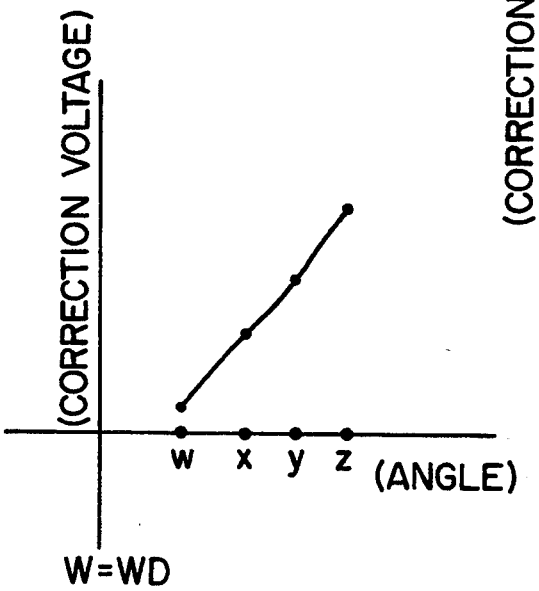
FIG. 4A is a graph of the voltage added to the normal error signal of the overall system for a given strip width WD and for changing tilt angles w–z.

In operation, the offset signal in line 100 is added to the error signal created by the voltages in lines 30, 32 to produce a tilt compensated signal in line 42. Referring now to FIG. 4, this graph illustrates the operating characteristics of the present invention. As the width of strip S increases, the operating point of the system shifts along the absissa. The corrective voltage for a given width, as factored into the difference signal DS, changes along a vertical straight line intersecting lines W(f)x, W(f)y, W(f)z and W(f)w. These lines are selected by the sensed tilt angle at any given time and represent the slopes for angles w,x,y,z, respectively. As the tilt angle changes an electrical value, such as the resistance added or subtracted by wiper 151 on potentiometer 152, is changed as shown in FIG. 4A. A different slope is used for creating the offset signal for a different strip width. As is noted, the error correcting graphs are approximately straight lines, i.e. or linear functions, in the first quadrant. Consequently, when the apparent width ES of the strip exceeds the centerline spacing CL of the cameras, a direct multiplication of the electrical value indicative of the tilt angle and the amount by which the width WD exceeds the centerline CL produces the desired correction in volts. These curves have been constructed mathematically to verify the operating characteristics of the present invention. At any particular angle, a straight line curve is employed for multiplying the spacing signal ES to obtain the desired offset voltage. This principle is employed in the tilt compensating system B shown in FIG. 2. For a given strip width WD, the tilt of less than 5° does not change substantially the position of the vertical line in FIG. 4 or the general straight characteristic of the curve of FIG. 4A.

A simplified drawing of the present invention, i.e. system B′ is illustrated in FIG. 3 wherein amplifier 200 has an input 202 for the spacing signal ES and an input 204 for a centerline signal. These signals are subtracted to produce a signal DS in output 206. This output is connected to gain control amplifier 210 and from the amplifier to the input of multiplier 220. The voltage on signal input line 222 is controlled by a transducer mechanism detecting the tilt angle of strip S passing under cameras 10, 12. An electrical value directly proportional to the tilt angle can be used as the multiple of multiplier 220. This procedure produces an output voltage in line 224 for the purposes of modifying the standard position correcting error signal to apply a slight tilt compensation value thereto.

The present invention can be employed with a camera detection system having a single camera; therefore, the centerline spacing CL is zero. In this instance, system B" shown in FIG. 5 can be employed. A gain control amplifier 230 has an input 232 indicative of the edge spacing of the strip S. The output line 234 is a function of the edge spacing ES determined by the gain adjustment of amplifier 230. The signal in line 234 is applied to multiplier 240 which has an input 242 from a feedback transducer providing signal indicative of the tilt angle for roll R, as shown in FIG. 2. The offset signal in line 244 is employed for compensation of the normal error signal as previously described. In some embodiments the system creates a tilt compensated error signal for use with error amplifier 40 of FIG. 1.

Referring now to FIGS. 6 and 7, the correction curve for a given tilt angle has a first slope (a) in the first quadrant and a second slope (b) in the third quadrant. Consequently, if the edge spacing signal ES is greater than the centerline spacing CL, the linear function for creating the correction signal is along the curve having slope (a). If the edge spacing of strip S is less than the centerline spacing CL, the same tilt angle produces a different correction ratio along slope (b) in the third quadrant. This dual slope concept is accomplished by the circuit C, shown in FIG. 6. Amplifier 250 has a first gain adjusted by resistor 252. Amplifier 260 has a separate second gain adjusted by resistor 262. The first gain is adjusted to slope (a) and the second gain is adjusted to slope (b). Diodes 270, 272 couple the output of amplifier 280 with amplifier 250, 260. Amplifier 280 has input lines 282, 284. The voltage on these inputs are subtracted to produce an output signal (ES−CL) in line 286. This signal is indicative of the difference between the apparent spacing of the strip edges that controls the value of the signal on line 282 and the centerline spacing of the cameras which controls the value of the signal on line 284. If the polarity of the signal in line 286 is positive, current flows through diode 270. Consequently, amplifier 250 is employed. This gives first quadrant operation along slope (a). If the signal in line 286 is negative, then current flows through diode 272. This current flow activates the linear function created by amplifier 260 having a slope adjusted by resistor 262. The operation of this feature is illustrated in FIG. 7 for one tilt angle. A family of these curves would be used as the tilt angle changes during operation of the system.

Another modification of the present invention is illustrated in FIG. 8 wherein amplifier 300 receives width indicative signals in lines 302, 304. The two signals combine to produce the apparent spacing of strip S passing through the detector system. The value of the signal on line 306 is adjusted to correspond with a voltage indicative of the centerline spacing between cameras 10, 12, as shown in FIG. 1. Thus, amplifier 300 produces a signal in line 308 which is the difference between the edge spacing and the centerline as previously described. This signal is applied to the gain control circuit 310 for adjusting the signal in line 312 indicative of the spacing of the strip from the cameras and other mechanical characteristics which are unique to the installation. This is a calibration function which allows adjustment of the tilt magnitude for use in the tilt compensation system D as shown in FIG. 8. The signal in lines 312 is introduced into AD 534 Internally Trimmed Precision IC Multiplier, sold by Analog Devices. The inputs 322 of chip 320 is moved along potentiometer 324 by the angle of roll R as shown in FIG. 2. This produces the electrical value employed for multiplying the signal in line 312. This multiplication produces an output signal in line 330 which is the offset tilt compensating signal for use with the standard error signal as discussed in conjunction with the preferred embodiment of the present invention illustrated in FIG. 2. This modification of the invention is illustrated only to show that a multiplying chip can be employed to obtain the relationship of $(ES-CL)\phi$ instead of the mechanical element and potentiometer now used in the preferred embodiment of the invention.

Figure 9:
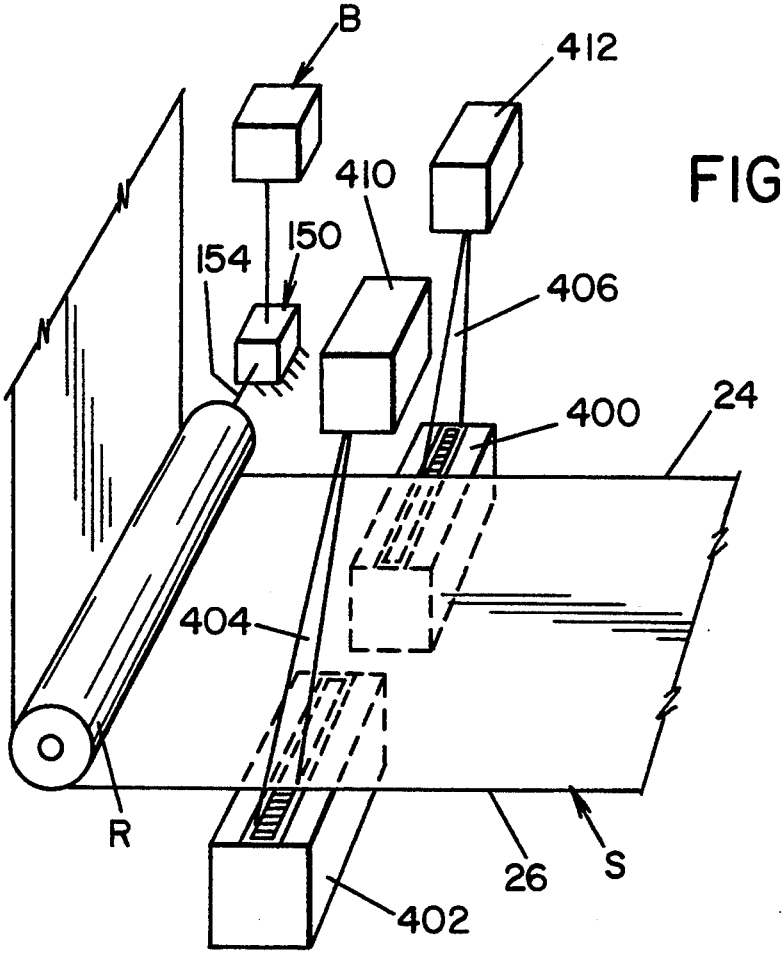
FIG. 9 is a pictorial view showing a non-contact measurement sensor which can employ the present invention; and, FIG. 10 is a graph showing the error calculated correction of the analog embodiment of FIG. 2.

As so far described, the preferred embodiments of the invention have been used for cameras having a conical field of view. It is possible to employ the present invention in several other systems employing conical fields of view, wherein the tilt angle produces a linear function for the corrective voltage required. In addition, the present invention can be employed for systems using light emitting diodes LED such as shown in FIG. 9 wherein a linear array of LED in light emitters 400, 402 has a generally fan shaped field of view 404, 406, respectively. These fields of view are detected by receivers 410, 412. This system is employed for measuring the final displacement of strip S as it passes over roll R by detecting the orthogonally projectable one dimensional lateral position of edges 24, 26. "Orthogonally projectable" indicates that the sensed lateral position of edges 24, 26 is determined, like a shadow, without factoring in the tilt of strip S. This is an operating characteristic of cameras and is also the operating characteristic of the detector system shown in FIG. 9. Movable element 154 detects the angular position of roll R as part of the feedback transducer 150. This element creates an electrical value representative of the angle, which electrical value is used in the tilt compensating circuit or system B as shown in FIG. 2.

Figure 5:
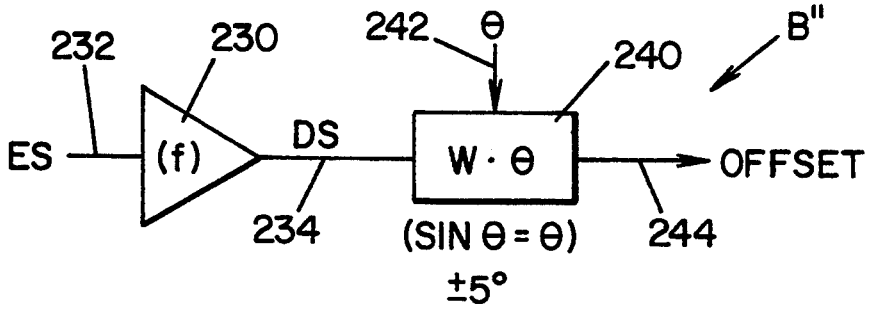
FIG. 5 is a block diagram showing a simplified embodiment of the present invention using a single camera.

Referring again to the various analog embodiments of the invention, the offset signal is obtained by multiplying a difference signal by a value indicative of the tilt angle. This value is best illustrated in FIG. 8 wherein input 322 is adjusted along potentiometer 324 to produce the electrical value in chip 320, which electrical value is indicative of the angle of tilt of roll R. This value is multiplied by the difference signal in line 312 to produce the output or offset signal. Thus, the slope of the correction line shown in FIG. 4 is determined by the magnitude of the tilt angle electrical value for any given strip width. As the angle changes, the correction signal is changed by the relationship: correction voltage equals $(ES-CL)\phi$. $(ES-CL)$ is a constant; consequently, correction is $K\phi$. The signal in line 322 is a voltage. It can be the setting of a potentiometer as shown in FIG. 2 and FIG. 8. Further, this angle created electrical value can be represented as a voltage indicative of the angle of tilt. This concept is schematically represented in FIGS. 3 and 5. The multiplying chip or multiplying stage of the present invention produces a linear output which has a slope determined by the detected tilt angle of the strip S as it passes under the detector means in the normal error signal detecting system. These electrical value can be obtained by an analog circuitry as shown in FIG. 2 or by digital circuitry.

Figure 10:
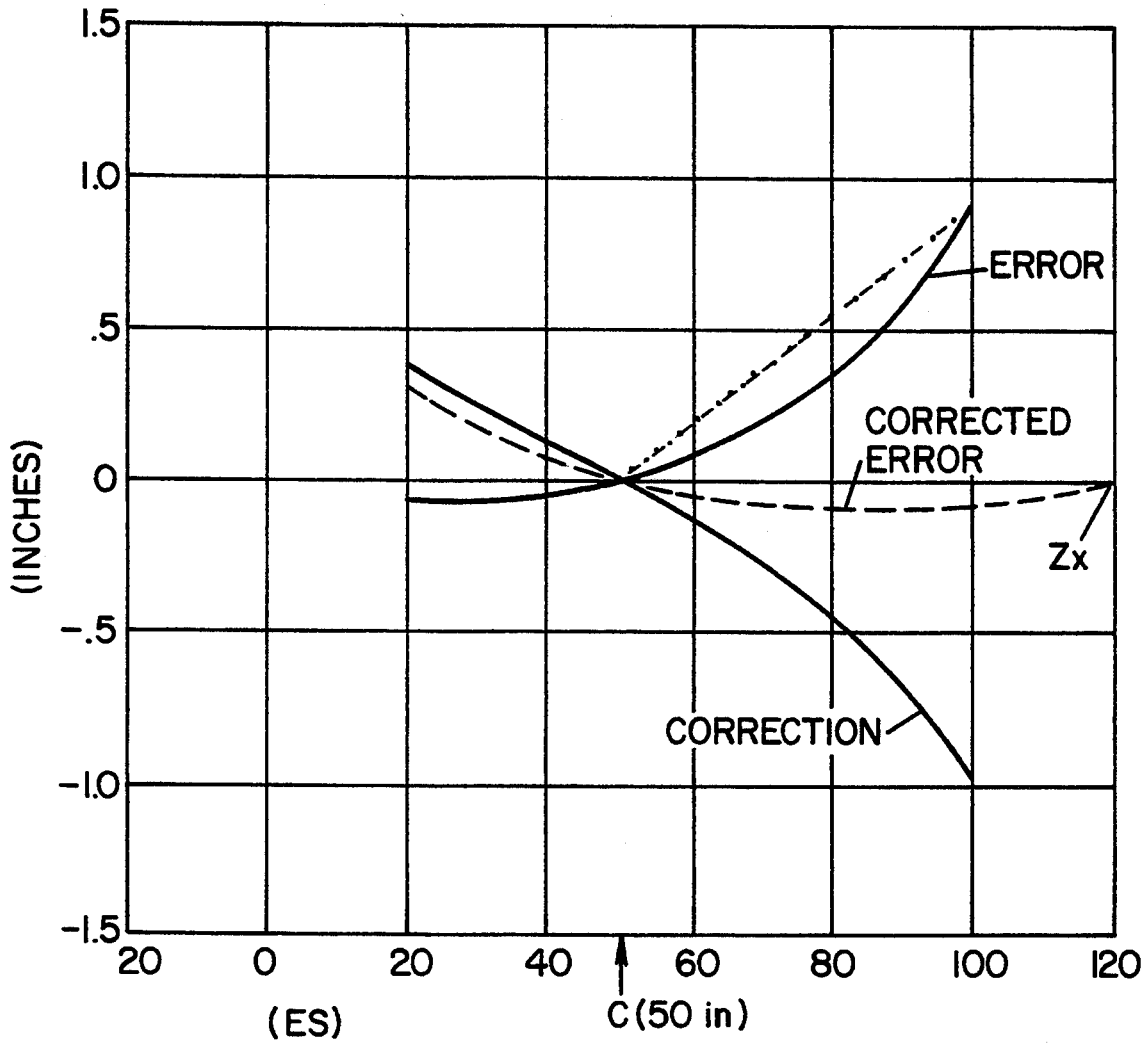
Figure 14:
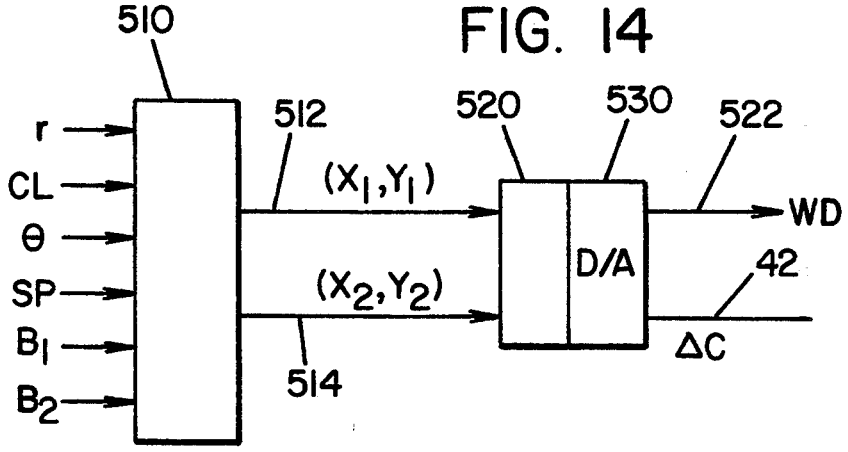

Referring now to FIG. 10, the graph is somewhat similar to the graph of FIG. 4 with the error calculated for various strip widths WD starting with an offset for the strip of 2.0 inches. Since the width WD of the strip is essentially the same as the edge spacing ES, i.e. the apparent strip width, the position on the graph of FIG. 10 can be indicated by the apparent width ES of the strip. With a strip offset of 2.0 inches and a small gain for amplifier 130, such as about 0.5, the calculated correction for a range of strip widths is shown. The system corrects the actual centerline position of the strip, as shown in the dashed line. This line passes through zero at point C and then shifts back to zero at point Zx. As can be seen, the corrected error signal of the invention substantially equals the actual error of the strip to provide a compensated corrected error. The correction is especially accurate for strip widths greater than the camera spacing, which is 50 inches in FIG. 10. Below the strip width WD−CL, the correction is not as linear. This accounts for the advisability of deactivating the system for strips substantially less in width than the centerline spacing of the cameras, or at least changing the gain in these negative quadrants as taught by the graph in FIG. 7.

A second embodiment of the invention is illustrated in FIGS. 11–14, wherein the system includes cameras C1, C2 spaced from each other a distance CL. Strip S has laterally spaced, parallel edges S1, S2 passing over a guide roll 500 pivoted by a frame at the point 502. Tilt angle $\phi$ is the angle at which the roll 500 is pivoted about point 502. This is essentially the same and can be detected by the potentiometer 144, shown in FIG. 2. The cameras C1, C2 detect the lateral position of edges S1, S2 as shown in FIGS. 12 and 13, respectively. The XY coordinates of the edges S1, S2 in space can be determined by the pivot radius r of roll 500, the optical angles $B_1$, $B_2$, the vertical position of strip S and the tilted position of strip S as shown in FIGS. 12, 13. These angles $B_1$, $B_2$ are a function of the spacing SP of roll 500 from cameras C1, C2, as well as the pivot radius r for the support frame of roll 300. By these quantities, the coordinates $X_1$, $Y_1$ of edge S1 and $X_2$, $Y_2$ of edge S2 can be calculated. These locations of the edges in space, allow determination of the actual center of the strip C and its spacing from the desired center $C_X$, i.e., the control position of the control system. The parameters illustrated in FIG. 11 and the angles $B_1$, $B_2$ shown in FIGS. 12 and 13, respectively, are input into a microprocessor 510, or other programmed processing unit, for creating coordinates in lines 512, 514. These ordinates are processed by appropriate software or by a designated processing chip 520 to produce analog outputs from an analog/digital converter 530, in lines 42, 522. The analog output in line 522 is an unnecessary output signal providing the value of the width of strip S. In accordance with the invention, the output in line 42 is the difference between the actual center C of strip S and the desired center $C_X$. This error or difference signal is analogous to the output of error amplifier 40, as shown in FIG. 1. This digitized embodiment of the present invention utilizes the information gathered by camera C1, C2 indicative of the lateral positions of edges S1, S2 and the tilt angle of roll 500 for determining the actual offset of the center of the strip, taking into consideration the tilt angle $\phi$. The error signal in line 42 combines strip offset and tilt by giving a signal indicative of the displacement of center C. The analog preferred embodiment can be performed by a digital preferred embodiment; however, the analog embodiment performs an approximation of the calculation that would be performed in the digital embodiment.

Having thus defined the invention, the following is claimed:

1. A system for creating a position correcting error signal indicative of the lateral displacement from a control position of a nearly flat web having a width and first and second generally parallel edges, as said generally flat web moves along a given feed line past a given location, said error signal creating device including first detector means for detecting the orthogonally projectable, one dimensional lateral position of said first edge of said moving web at said given location, second detector means for detecting the orthogonally projectable, one dimensional lateral position of said second edge of said moving web at said given location, said first and second detector means being spaced from each other a given distance, said first and second detector means being spaced from said web at said location a known spacing amount in a direction perpendicular to said web, and means for comparing said lateral positions of said first and second edges to generate said error signal, said system further comprising: transducer means for detecting the lateral tilt angle of said web at said given location, means for creating an electrical value based upon said detected tilt angle, means for creating a signal indicative of the difference between said given distance between said first and second detector means and said width of said web, means for multiplying said difference signal and said electrical value to produce an offset signal and means responsive to said offset signal for providing a tilt compensated error signal for reducing said lateral displacement of said web from said control position.

2. A system as defined in claim 1 wherein said first and second detector means are cameras, each having a conical field of vision with a centerline spaced laterally of said feed line at said given location, the distance between said centerlines being said given distance.

3. A system as defined in claim 1 wherein said transducer means includes a means for detecting the angular disposition of a web guide roll adjacent said given location and means for converting said detected angular position into an electrical parameter indicative of the angular disposition of said roll and, thereby, the general tilt angle of said web at said location.

4. A system as defined in claim 3 wherein said detecting means for said angular disposition of said roll is a mechanical element carried by said guide roll.

5. A system as defined in claim 4 wherein said converting means is a variable impedance device linearly adjusted by said mechanical element.

6. A system as defined in claim 4 wherein said converting means is a linearly adjusted electrical device having means for adjusting said electrical device by said mechanical element.

7. A system as defined in claim 6 wherein said electrical device is a multiplier circuit having a multiplier value controlled by said mechanical element.

8. A system as defined in claim 1 wherein said transducer means includes a means for detecting the angular disposition of said web and means converting said detected angular disposition into an electrical parameter indicative of the angular disposition of said web at said location.

9. A system as defined in claim 8 wherein said converting means is a linearly adjustable electrical device having means for adjusting the electrical parameter of said electrical device by the detected angular disposition of said web.

10. A system as defined in claim 9 wherein said electrical device is a multiplier circuit having a multiplier value controlled by said detected angular disposition of said web.

11. A system as defined in claim 1 wherein said first and second detector means are combined as a single detector whereby said given distance is zero.

12. A system as defined in claim 1 wherein said means for creating said difference signal includes a summing component having a first input with a value representative of the apparent width of said web and an opposite polarity signal indicative of said given distance.

13. A system as defined in claim 12 wherein said opposite polarity signal is manually adjusted.

14. A system as defined in claim 13 wherein said summing component is an operational amplifier.

15. A system as defined in claim 12 wherein said summing component is an operational amplifier.

16. A system as defined in claim 1 including means for adjusting the magnitude of said difference signal.

17. A system as defined in claim 16 including means for setting said magnitude at a first level when said difference signal has a first electrical sign and at a second level when said difference signal has a sign opposite to said first sign.

18. A system as defined in claim 1 wherein said first and second detector means are light transmitting sources on one side of said feed line and light sensitive receiving elements on the other side of said feed line.

19. A system as defined in claim 1 wherein said transducer means includes a mechanical element movable by a corrective guide roll for said web at said location.

20. A method of compensating for web tilt in a device to create a position correcting error signal indicative of the lateral displacement from a control position of a nearly flat web having a width and first and second generally parallel edges as said generally flat web moves along a given feed line past a given location, said error signal creating device including first detector means for detecting the orthogonally projectable, one dimensional lateral position of said first edge of said moving web at said given location, second detector means for detecting the orthogonally projectable, one dimensional lateral position of said second edge of said moving web at said given location, said first and second detector means being spaced from each other a given distance and said first and second detector means being spaced from said web at said location a spacing amount in a direction perpendicular to said web, and means for comparing said lateral positions of said first and second edges to generate said error signal, said method comprising the steps of:

(a) detecting the lateral tilt angle of said web at said given location;

(b) creating an electrical value based upon said detected tilt angle;

(c) creating a difference signal indicative of the difference between said given distance between said first and second detector means and said width of said web;

(d) multiplying said difference signal and said electrical value to produce an offset signal; and, (e) combining said offset signal and said error signal to provide a tilt compensated error signal for reducing said lateral displacement of said web from said control position.

21. The method as defined in claim 20 wherein said tilt angle detecting step includes the steps of detecting the angular disposition of a web guide roll adjacent said given location and converting said detected angular position into an electrical parameter indicative of the angular disposition and, thereby, the general tilt angle of said web at said location.

22. The method as defined in claim 20 wherein said difference signal creating step includes the steps of summing a signal representative of said width of said web and an opposite polarity signal indicative of said given distance.

23. The method as defined in claim 20 including the additional step of adjusting the magnitude of said difference signal.

24. The method as defined in claim 23 including the additional steps of setting said magnitude at a first level when said difference signal has a first electrical sign and at a second level when said difference signal has a sign opposite to said first sign.

25. A method for creating a position correcting error signal in an error signal creating device, said error signal indicative of the lateral displacement from a control position of a nearly flat web having a width and first and second generally parallel edges as said generally flat web moves along a given feed line past a given location, said error signal creating device including first detector means for detecting the orthogonally projectable, one dimensional lateral position of said first edge of said moving web at said given location, second detector means for detecting the orthogonally projectable, one dimensional lateral position of said second edge of said moving web at said given location, said first and second detector means being spaced from each other a given distance and said first and second detector means being spaced from said web at said location a spacing amount in a direction perpendicular to said web, and means for comparing said lateral positions of said first and second edges to generate said error signal, said method comprising the steps of:

(a) detecting the lateral tilt angle of said web at said given location;

(b) creating an electrical value based upon said detected tilt angle; and (c) using said electrical value to provide a tilt compensated error signal for reducing said lateral displacement.

26. A system for creating a position correcting error signal in an error signal creating device, said error signal indicative of the lateral displacement from a control position of a nearly flat web having a width and first and second generally parallel edges as said generally flat web moves along a given feed line past a given location, said error signal creating device including first detector means for detecting the orthogonally projectable, one dimensional lateral position of said first edge of said moving web at said given location, second detector means for detecting the orthogonally projectable, one dimensional lateral position of said second edge of said moving web at said given location, said first and second detector means being spaced from each other a given distance and said first and second detector devices being spaced from said web at said location a spacing amount in a direction perpendicular to said web, and means for comparing said lateral positions of said first and second edges to generate said error signal, said system comprising transducer means for detecting the lateral tilt angle of said web at said given location, means for creating an electrical value based upon said detected tilt angle, means for creating a difference signal indicative of the difference between said given distance between said first and second detector means and said width of said web, and means responsive to said difference signal and said electrical value to produce an offset signal that can be combined with said error signal to provide a tilt compensated error signal for reducing said lateral displacement of said web from said control position.

27. An improvement in a system for creating a position correcting error signal in an error signal creating device, said error signal indicative of the lateral displacement from a center control position for a nearly flat web having a width and first and second generally parallel edges, as said generally flat web moves along a given feed line past a given location, said error signal creating device including means for detecting the orthogonally projectable, one dimensional lateral position of said first edge of said moving web at said given location, means for detecting the orthogonally projectable, one dimensional lateral position of said second edge of said moving web at said given location, and means for comparing said lateral positions of said first and second edges to generate said error signal indicative of the apparent spacing of the center of said web from said center control position, the improvement comprising:

transducer means for detecting the lateral tilt angle of said web at said given location, means for creating an electrical value based upon said detected tilt angle, means responsive to said electrical value and said position correcting error signal for creating a tilt compensated error signal indicative of actual spacing of the center of said web from said center control position, means for using said tilt compensated error signal for reducing said lateral displacement of said web from said control position.

28. A system as defined in claim 27 wherein said detector means is a camera with a conical field of vision at said given location.

29. A method of compensating for web tilt in a device to create a position correcting error signal indicative of the lateral displacement from a control position of the actual center of a nearly flat web having a width and first and second generally parallel edges as said generally flat web moves along a given feed line past a given location, said error signal creating device including first detector means for detecting the orthogonally projectable, one dimensional lateral position of said first edge of said moving web at said given location, second detector means for detecting the orthogonally projectable, one dimensional lateral position of said second edge of said moving web at said given location, said first and second detector means being spaced from each other a given distance and said first and second detector means being spaced from said web at said location a spacing amount in a direction perpendicular to said web, and means for comparing said lateral positions of said first and second edges to generate said error signal indicative of the apparent center of said web, said method comprising the steps of:

(a) detecting the lateral tilt angle of said web at said given location;

(b) creating an electrical value based upon said detected tilt angle;

(c) creating a center offset signal indicative of the actual center of said web; and, (d) combining said center offset signal and said error signal to provide a tilt compensated error signal for reducing said lateral displacement of said actual center of web from said control position.

30. In a system for creating a position correcting error signal in an error signal creating device, said error signal indicative of the lateral displacement of the center of a web from a control position for the center of a nearly flat web having a width and first and second generally parallel edges, as said generally flat web moves along a given feed line past a given location, said error signal creating device including means for detecting the orthogonally projectable, one dimensional lateral position of said first edge of said moving web at said given location, means for detecting the orthogonally projectable, one dimensional lateral position of said second edge of said moving web at said given location, the improvement comprising: transducer means for detecting the lateral tilt angle of said web at said given location, means for creating an electrical value based upon said detected tilt angle, means for creating edge signals indicative of the detected lateral positions of the edges of said web, and means responsive to said edge signals and said electrical value for providing a tilt responsive error signal for reducing said lateral displacement of said web center from said central position for said web center.

31. In a system for creating a position correcting error signal in an error signal creating device, said error signal indicative of the lateral displacement of the center of a web from a control position for the center of a nearly flat web having a width and first and second generally parallel edges, as said generally flat web moves along a given feed line past a given location, said error signal creating device including means for detecting the orthogonally projectable, one dimensional lateral position of said first edge of said moving web at said given location, means for detecting the orthogonally projectable, one dimensional lateral position of said second edge of said moving web at said given location, the improvement comprising: transducer means for detecting the lateral tilt angle of said web at said given location, means for creating an electrical value based upon said detected tilt angle, and means responsive to said electrical value and said error signal for creating a signal indicative of the offset of the actual center of the web from said position.

* * * * *